United States Patent [19]

Takita et al.

[11] Patent Number: 5,076,840

[45] Date of Patent: Dec. 31, 1991

[54] ELECTROLESS COPPER PLATING SOLUTION

[75] Inventors: Takao Takita, Yuki; Takeshi Shimazaki, Shimodate; Satoshi Akazawa, Shimodate; Kazuichi Kuramoti, Shimodate; Hiroyuki Toyoda, Tochigi, all of Japan

[73] Assignees: Hitachi Chemical Co. Ltd.; Hitachi Borden Chemical Products, Inc., both of Tokyo, Japan

[21] Appl. No.: 460,983

[22] Filed: Jan. 4, 1990

[30] Foreign Application Priority Data

Jan. 13, 1989 [JP] Japan ..... 1-007092

[51] Int. Cl.[5] ..... C23C 18/40

[52] U.S. Cl. ..... 106/1.23; 106/1.26

[58] Field of Search ..... 106/1.23, 1.26

[56] References Cited

U.S. PATENT DOCUMENTS 4,171,225 10/1979 Molenaar et al. ..... 106/1.23
4,374,876 2/1983 El-Shazly et al. ..... 106/1.23
4,548,644 10/1985 Nakaso et al. ..... 106/1.23

FOREIGN PATENT DOCUMENTS 70931 6/1978 Japan .
59-870 4/1984 Japan .
60-9880 1/1985 Japan .
60-218480 11/1985 Japan .
12871 1/1986 Japan .
253375 11/1986 Japan .
62-89877 4/1987 Japan .

*Primary Examiner*—William R. Dixon, Jr.
*Assistant Examiner*—Helene Klemanski
*Attorney, Agent, or Firm*—Antonelli, Terry, Stout & Kraus

[57] ABSTRACT

An electroless copper plating solution comprising a cupric salt, a copper complexing agent, a reducing agent, a pH adjustor, L-arginine and at least one of $\alpha,\alpha'$-dipyridyl and a cyano complex compound can give plated films high in ductility and adhesive strength and excellent in mechanical properties.

7 Claims, 1 Drawing Sheet

ELECTROLESS COPPER PLATING SOLUTION

BACKGROUND OF THE INVENTION

This invention relates to an electroless copper plating solution used for producing printed wiring boards.

An electroless copper plating solution heretofore known comprises a cupric salt such as cupric sulfate, an alkali-soluble complexing agent for cupric ions such as ethylenediaminetetraacetic acid, a reducing agent such as formaldehyde and a pH adjustor such as an alkali hydroxide. But there are problems in that such an electroless copper plating solution is poor in stability of the solution and generally provides a brittle plated film. In order to solve such problems, there are proposed to add various additives such as cyanogen compounds e.g., sodium cyanide, lactonitrile, etc.; nitrogen-containing organic compounds, e.g. $\alpha,\alpha'$-dipyridyl, ethylaminoethanolamine, rhodanine, etc.; and sulfur-containing compounds, e.g., thiourea, benzothiazole, 2-mercaptobenzothiazole, potassium sulfide, etc. (Japanese Patent Unexamined Publication No. 52-1733, Japanese Patent Examined Publication No. 43-12966).

But a plating solution containing an inorganic cyanide such as sodium cyanide, or lactonitrile is poor in adhesiveness to a substrate having through-holes and often brings about semi-spherical blisters on inner walls of through-holes due to stress from plating deposition. There is a tendency to increase blisters with accumulation of by-produced materials in the plating solution. Such blisters easily bring about peeling during the production step, resulting in producing plating voids.

On the other hand, nitrogen-containing organic compounds and sulfur compounds such as thiourea, rhodanine, potassium sulfide, etc. are effective for stabilizing the plating solution, but suppress the deposition rate and give poor surface appearance of deposited copper. Further, the deposited copper obtained by using a plating solution containing such an additive is poor in surface gloss compared with the case of using an inorganic cyanide, and is easily oxidizable since the surface of deposited copper is activated. The adhesiveness between the plated film and substrate is not a problem in a subtractive process wherein a primary electric copper plating is conducted. According to a primary panel electric copper plating-omitting process, copper is deposited in 2-3 $\mu$m thick only by electroless copper plating in order to simplify the process, followed by resist formation and copper plating of pattern. When a dry film is directly laminated without chemical or mechanical polishing in such a process, there is a problem of causing a phenomenon of penetration of solder plating under a floating resist due to poor adhesive strength between deposited copper by plating and the resist (dry film) (hereinafter referred to as "underplating").

Further, in the case of an electroless copper plating solution suitable for producing printed wiring boards by an additive process wherein printed wiring boards are produced by only electroless copper plating, there are problems in that mechanical properties of plated films are insufficient, copper films are broken by expansion and shrinkage of printed wiring boards.

SUMMARY OF THE INVENTION

It is an object of the present invention to provide an electroless copper plating solution without causing blisters on inner walls of through-holes, excellent in surface appearance of plated film, depositing rate and stability of the solution, and giving strong adhesiveness to films even if a dry film is directly laminated by the primary panel electric copper plating-omitting process.

It is another object of the present invention to provide an electroless copper plating solution which can give a plated film excellent in mechanical properties and used for printed wiring boards produced by the additive process.

The present invention provides an electroless copper plating solution comprising a cupric salt, a copper complexing agent, a reducing agent, a pH adjustor in combination with L-arginine and at least one of $\alpha,\alpha'$-dipyridyl and a cyano complex compound.

BRIEF DESCRIPTION OF THE DRAWING

The attached drawing shows a pattern for adhesion test.

DESCRIPTION OF THE PREFERRED EMBODIMENTS

Figure 1:
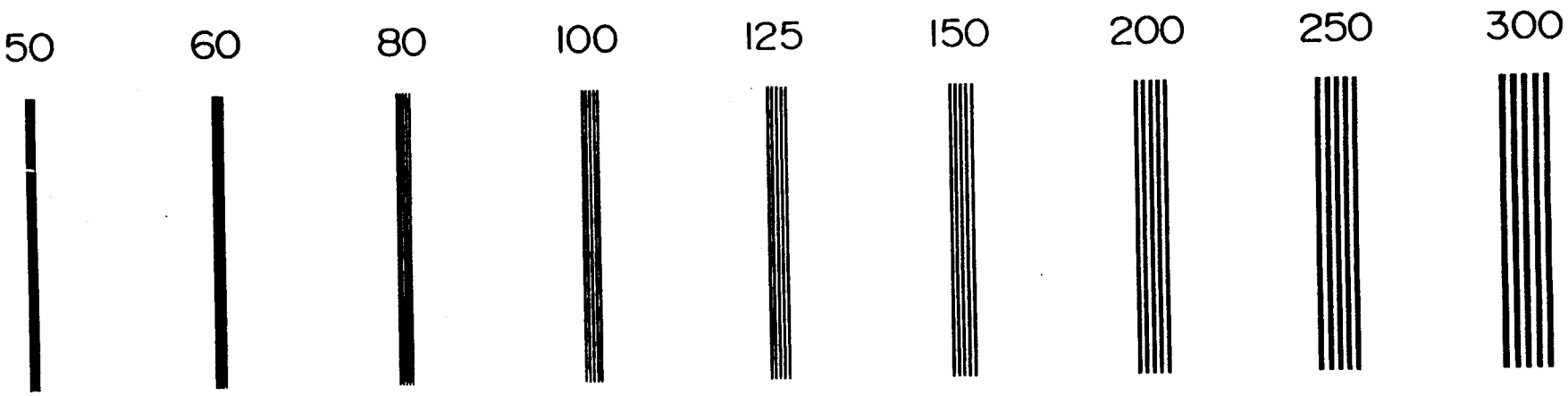

The electroless copper plating solution of the present invention contains as essential components a cupric salt, a complexing agent, a reducing agent, and a pH adjustor such as an alkali hydroxide.

As the cupric salt, there can be used cupric sulfate, cupric nitrate, cupric chloride, etc. The cupric salt is usually used in a concentration of 3.0 to 15.0 g/l.

As the complexing agent, there can be used Rochelle salts, Quadrol a trademark of BASF-Wyandott Corp. for N,N,N',N'-tetrakis-(2-hydroxypropyl)ethylenediamine. N,N,N',N'-tetrakisethylenediamine, ethylenediaminetetraacetic acid, etc. From the viewpoints of plating properties, solution stability and waste liquid treatment, the use of ethylenediaminetetraacetic acid is preferable. The complexing agent is usually used in a concentration of 30.0 to 65.0 g/l.

As the reducing agent, formaldehyde is generally used. It is possible to use paraformaldehyde. The reducing agent is usually used in a concentration of 1.0 to 20.0 ml/l.

As the pH adjustor, an alkali hydroxide is used to adjust the pH of the solution. The plating solution is preferably adjusted at pH 11.80 to 13.00.

The electroless copper plating bath temperature is usually 30.0° to 75° C.

In the present invention, in addition to the above-mentioned essential components, there are used L-arginine and at least one of $\alpha,\alpha'$-dipyridyl and a cyano complex compound, that is, L-arginine and $\alpha,\alpha'$-dipyridyl, L-arginine and a cyano complex compound, and L-arginine, $\alpha,\alpha'$-dipyridyl and a cyano complex compound.

The concentration of $\alpha,\alpha'$-dipyridyl in the plating solution is preferably 5 to 100 mg/l, more preferably 10 to 50 mg/l.

The concentration of L-arginine in the plating solution is preferably 0.05 to 50 mg/l, more preferably 0.1 to 20 mg/l.

As the cyano complex compound, there can be used sodium ferroyanide ($Na_4[Fe(CN)_6]$), potassium ferrocyanide ($K_4[Fe(CN)_6]$), sodium ferricyanide ($Na_3[Fe(CN)_6]$), potassium ferricyanide ($K_3[Fe(CN)_6]$), potassium nickelcyanide ($K_2Ni(CN)_6$), sodium nitroprusside ($Na_2Fe(CN)_5NO$), etc. alone or as a mixture thereof. The concentration of the cyano complex compound is preferably 0.05 to 30 mg/l, more preferably 0.1 to 10 mg/l.

When the concentration of $\alpha,\alpha'$-dipyridyl is less than 5 mg/l, an effect for stabilizing the plating solution is small, while when the concentration is more than 100 mg/l, the plating rate is lowered. When the concentration of L-arginine is less than 0.05 mg/l, an effect for stabilizing the plating solution is small, while when the concentration is more than 50 mg/l, the depositing rate of plating is lowered.

When the concentration of cyano complex compound is less than 0.5 mg/l, surface appearance of deposited copper at lower temperatures and the solution stability are insufficient, while when the concentration is more than 30 mg/l, blisters are often generated on inner walls of through-holes.

When $\alpha,\alpha'$-dipyridyl and L-arginine are combined with the essential components of the plating solution, there can be obtained an electroless copper plating solution which is good in solution stability and can deposit copper with less plating deposition stress.

When L-arginine and a cyano complex compound are combined with the essential components of the plating solution, there can be obtained an electroless copper plating solution which is improved in plating deposition rate, and can give improved surface appearance and mechanical properties of plated films.

When $\alpha,\alpha'$-dipyridyl, L-arginine and a cyano complex compound are combined with the essential components of the plating solution, there can be obtained an electroless copper plating solution which is excellent in solution stability and can give plated films having no blisters and difficult to be covered with an oxidized film after electroless copper plating.

The present invention is illustrated by way of the following Examples, in which all percents are by weight unless otherwise specified.

In the following Examples 1-10 and Comparative Examples 1-7, there were used as essential components 10 g/l of cupric sulfate pentahydrate, 45 g/l of ethylenediaminetetraacetic acid, and 10 ml/l of formalin (37%) to adjust the pH to 12.50 (at 20° C). Electroless copper plating was carried out using a plating solution at a liquid temperature of 60° C. for 30 minutes with a plating area of 2.5 $dm^2/l$ on a double-sided copper-clad glass-epoxy laminate (MCL-E67, mfd. by Hitachi Chemical Co., Ltd.).

The copper-clad glass-epoxy laminate was subjected to drilling of through-holes with a drill having a diameter of 1.0 mm, buffing using an emery blast and washing with high-pressure water. The laminate was then subjected to pretreatments shown in Table 1, followed by electroless plating.

Blisters were evaluated by cutting the laminate having through-holes using a precise low-speed cutter at the centers of though-holes and counting the number of blisters using a microscope (×40).

Stability of a plating solution is lowered with the progress of side reactions of plating. This can be shown by the following equations:

$$Cu.EDTA^{2-} + HCHO + 5OH^- \rightarrow CuO + HCOO^- +$$

$$3H_2O + EDTA^{4-} Cu_2O + H_2O \rightleftharpoons Cu^0 + Cu^{2+} + 2OH$$

Thus, 5 mg/l of cuprous oxide ($Cu_2O$) was added to a plating solution and the presence of deposited decomposed copper on the bottom of a beaker was observed after 5 hours' plating for evaluating the stability of plating solution.

Adhesive strength to a dry film was measured as follows. After the pretreating plating shown in Table 1, the laminate was subjected to the laminate pretreating steps shown in Table 2. As a pattern for adhesion test, that shown in the attached drawing was used. After solder plating, the state of lines of the pattern was observed using a microscope. The number of normal lines among five lines was counted. The evaluation of 2/5, for example, means that 2 lines are normal among 5 lines. The evaluation of 5/5 means that there is no flying nor bending of the lines and adhesive strength is excellent. In the drawing, the numerals mean a line width and a line distance (line width=line distance, in $\mu$m).

EXAMPLE 1

An electroless copper plating solution was prepared by adding 30 mg/l of $\alpha,\alpha'$-dipyridyl and 5 mg/l of L-arginine to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

EXAMPLE 2

An electroless copper plating solution was prepared by adding 30 mg/l of $\alpha,\alpha'$-dipyridyl, 5 mg/l of potassium ferrocyanide and 0.5 mg/l of L-arginine to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

EXAMPLE 3

An electroless copper plating solution was prepared by adding 5 mg/l of $\alpha,\alpha'$-dipyridyl, 0.05 mg/l of potassium ferrocyanide and 0.05 mg/l of L-arginine to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

EXAMPLE 4

An electroless copper plating solution was prepared by adding 100 mg/l of $\alpha,\alpha'$-dipyridyl, 30 mg/l of potassium ferrocyanide and 50 mg/l of L-arginine to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

EXAMPLE 5

An electroless copper plating solution was prepared by adding 30 mg/l of $\alpha,\alpha'$-dipyridyl and 0.5 mg/l of L-arginine to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

EXAMPLE 6

An electroless copper plating solution was prepared by adding 5 mg/l of α,α'-dipyridyl and 10 mg/l of L-arginine to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

EXAMPLE 7

An electroless copper plating solution was prepared by adding 0.5 mg/l of L-arginine and 3 mg/l of potassium ferrocyanide to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

EXAMPLE 8

An electroless copper plating solution was prepared by adding 3 mg/l of L-arginine and 3 mg/l of potassium nickelcyanide to the essential components mentioned above. Electroless copper plating was carried out using the resulting plating solution.

Plating deposition rate, plated surface appearance, solution stability, and mechanical properties were shown in Table 3. Results of adhesive strength to a dry film shown in Table 4.

EXAMPLE 9

An electroless copper plating solution was prepared by adding 10 mg/l of α,α'-dipyridyl, 0.05 mg/l of L-arginine and 0.1 mg/l of potassium ferrocyanide to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

EXAMPLE 10

An electroless copper plating solution was prepared by adding 30 mg/l of α,α'-dipyridyl, 0.1 mg/l of L-arginine and 0.1 mg/l of potassium nickelcyanide to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

COMPARATIVE EXAMPLE 1

An electroless copper plating solution was prepared by adding 30 mg/l of α,α'-dipyridyl, 5 mg/l of potassium ferrocyanide and 0.5 mg/l of thiourea to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

COMPARATIVE EXAMPLE 2

An electroless copper plating solution was prepared by adding 30 mg/l of α,α'-dipyridyl, 5 mg/l of ferrocyanide and 0.5 mg/l of rhodanine to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

COMPARATIVE EXAMPLE 3

An electroless copper plating solution was prepared by adding 30 mg/l of α,α'-dipyridyl, 5 mg/l of ferrocyanide and 0.5 mg/l of 2-mercaptobenzothiazole to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

COMPARATIVE EXAMPLE 4

An electroless copper plating solution was prepared by adding 30 mg/l of α,α'-dipyridyl, and 25 mg/l of sodium cyanide to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

COMPARATIVE EXAMPLE 5

An electroless copper plating solution was prepared by adding 30 mg/l of α,α'-dipyridyl and 25 mg/l of lactonitrile to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

COMPARATIVE EXAMPLE 6

An electroless copper plating solution was prepared by adding 30 mg/l of α,α'-dipyridyl and 5 mg/l of potassium ferrocyanide to the essential components mentioned above. Electroless copper plating was carried out using the resulting plating solution.

Plating deposition rate, plated surface appearance, solution stability, and mechanical properties were shown in Table 3. Results of adhesive strength to a dry film were shown in Table 4.

COMPARATIVE EXAMPLE 7

An electroless copper plating solution was prepared by adding 30 mg/l of α,α'-dipyridyl and 5 mg/l of rhodanine to the essential components mentioned above.

Electroless copper plating was carried out using the resulting plating solution.

Plating deposition rate, plated surface appearance, solution stability, and mechanical properties were shown in Table 3. Results of adhesive strength to a dry film were shown in Table 4.

TABLE 1

| No. | Pretreating steps | Treating time (min) |
|---|---|---|
| 1 | CLC-201 *1 60° C. | 4 |
| 2 | Washing with hot water | 2 |
| 3 | Washing with water | 2 |
| 4 | Ammonium persulfate | 2 |
| 5 | Washing with water | 1 |
| 6 | 10% $H_2SO_4$ | 1 |
| 7 | Washing with water | 1 |
| 8 | Predipping (PD-201) *2 | 3 |
| 9 | HS-201B *3 | 8 |
| 10 | Washing with water | 3 |
| 11 | ADP-301 *4 | 5 |
| 12 | Washing with water | 1 |
| 13 | Electroless copper plating | 30 |

Note)
*1: CLC-201: Cleaner conditioner for degreasing (mfd. by Hitachi Chemical Co., Ltd.)
*2: Predipping (PD-201): Hydro-extracting, pretreating liquid for electroless plating (mfd. by Hitachi Chemical Co., Ltd.)
*3: HS-201B: Catalyst of electroless copper plating (mfd. by Hitachi Chemical Co., Ltd.)
*4: ADP-301: Adhesion accelerating agent (mfd. by Hitachi Chemical Co., Ltd.)

TABLE 2

| No. | Steps | Treating time (min) | Note |
|---|---|---|---|
| 1 | Plating pretreating step | — | *5 |
| 2 | Electroless copper plating | 30 | |
| 3 | Washing with water | 1 | |
| 4 | Washing with hot water (50–60° C.) | 2 | |
| 5 | Rust prevention treatment | 2 | |
| 6 | Washing with water | 1 | |
| 7 | Washing with water | 1 | |
| 8 | Washing with hot water (50–60° C.) | 2 | |
| 9 | Drying (85–90° C.) | 20 | |
| 10 | Laminating (4 kg/cm$^2$) | — | *6 |
| 11 | Baking | — | *7 |
| 12 | Development | | |
| 13 | Electric plating | 42 | *8 |
| 14 | Solder plating | 12 | *9 |

Note)
*5: Steps shown in Table 1
*6: Preheating at 50° C.
*7: Light exposure amount upper stage 75 mJ lower stage 65 mJ
*8: 3 A/dm$^2$
*9: 2 A/dm$^2$

TABLE 3

| | | Additive (ml/l) A | B | C | Other additives | | Plating deposition rate (μm/30 min) | Plated surface appearance | Solution stability | Number of blister per 100 holes | Elongation (%)* | Tensile strength* (kgf/cm$^2$) |
|---|---|---|---|---|---|---|---|---|---|---|---|---|
| Examples | 1 | 30 | — | 5 | | | 1.23 | Pink | Stable | 0 | 9.0 | 32 |
| | 2 | 30 | 5 | 0.5 | | | 1.62 | " | " | 0 | 8.5 | 37 |
| | 3 | 5 | 0.05 | 0.05 | | | 2.05 | " | " | 0 | 8.3 | 35 |
| | 4 | 100 | 30 | 50 | | | 1.10 | " | " | 0 | 8.3 | 35 |
| | 5 | 30 | — | 0.5 | | | 1.23 | " | " | 0 | 9.2 | 34 |
| | 6 | 5 | — | 10 | | | 1.15 | " | " | 0 | 6.9 | 29 |
| | 7 | — | 3 | 0.5 | | | 1.31 | " | " | 0 | 7.5 | 30 |
| | 8 | — | 3 | 3 | | | 1.20 | " | " | 0 | 7.2 | 28 |
| | 9 | 10 | 0.1 | 0.05 | | | 1.34 | " | " | 0 | 8.5 | 30 |
| | 10 | 30 | 0.1 | 0.1 | | | 1.26 | " | " | 0 | 8.4 | 32 |
| Comparative Examples | 1 | 30 | 5 | — | Thiourea | 0.5 | 1.54 | Brown | Stable | 0 | 1.6 | 25 |
| | 2 | 30 | 5 | — | Rhodanine | 0.5 | 1.61 | Pale brown | Decomposed | 4 | 2.7 | 28 |
| | 3 | 30 | 5 | — | 2-Mercapto benzothiazole | 0.5 | 1.11 | Brown | Stable | 0 | 2.5 | 23 |
| | 4 | 30 | — | — | Sodium cyanide | 25 | 0.86 | Pink | " | 61 | 3.2 | 29 |
| | 5 | 30 | — | — | Lactonitrile | 25 | 0.83 | " | " | 58 | 3.3 | 30 |
| | 6 | 30 | — | — | — | — | 2.20 | " | Decomposed | 0 | 1.5 | 20 |
| | 7 | 30 | — | — | Rhodanine | 0.5 | 1.00 | Pale brown | Stable | 0 | 2.2 | 24 |

A: α,α'-dipyridyl
B: Cyano complex compound: potassium ferrocyanide (Example 1–7 & 9) potassium nickelcyanide (Examples 8 & 10)
C: L-arginine
Plating depostion rate: copper foil deposited on a stainless steel plate (1 dm$^2$/l) was measured by the weighing method.
*See Table 5.

TABLE 4

| | | Adhesive strength to dry film 50 μm | 60 μm | 80 μm | 100 μm | 125 μm | 150 μm | 200 μm | 250 μm | 300 μm |
|---|---|---|---|---|---|---|---|---|---|---|
| Examples | 1 | 5/5 | 5/5 | 5/5 | 5/5 | 5/5 | 5/5 | 5/5 | 5/5 | 5/5 |
| | 2 | 5/5 | 5/5 | 5/5 | 5/5 | 5/5 | 5/5 | 5/5 | 5/5 | 5/5 |
| | 3 | 5/5 | 5/5 | 5/5 | 5/5 | 5/5 | 5/5 | 5/5 | 5/5 | 5/5 |
| | 4 | 5/5 | 5/5 | 5/5 | 5/5 | 5/5 | 5/5 | 5/5 | 5/5 | 5/5 |
| | .5 | 5/5 | 5/5 | 5/5 | 5/5 | 5/5 | 5/5 | 5/5 | 5/5 | 5/5 |
| | 6 | 5/5 | 5/5 | 5/5 | 5/5 | 5/5 | 5/5 | 5/5 | 5/5 | 5/5 |
| | 7 | 5/5 | 5/5 | 5/5 | 5/5 | 5/5 | 5/5 | 5/5 | 5/5 | 5/5 |
| | 8 | 5/5 | 5/5 | 5/5 | 5/5 | 5/5 | 5/5 | 5/5 | 5/5 | 5/5 |
| | 9 | 5/5 | 5/5 | 5/5 | 5/5 | 5/5 | 5/5 | 5/5 | 5/5 | 5/5 |
| | 10 | 5/5 | 5/5 | 5/5 | 5/5 | 5/5 | 5/5 | 5/5 | 5/5 | 5/5 |
| Comparative Examples | 1 | 3/5 | 3/5 | 4/5 | 5/5 | 5/5 | 5/5 | 5/5 | 5/5 | 5/5 |
| | 2 | 4/5 | 4/5 | 4/5 | 5/5 | 5/5 | 5/5 | 5/5 | 5/5 | 5/5 |

TABLE 4-continued

| | Adhesive strength to dry film | | | | | | | | |
|---|---|---|---|---|---|---|---|---|---|
| | 50 μm | 60 μm | 80 μm | 100 μm | 125 μm | 150 μm | 200 μm | 250 μm | 300 μm |
| 3 | 1/5 | 1/5 | 3/5 | 3/5 | 3/5 | 5/5 | 5/5 | 5/5 | 5/5 |
| 4 | 5/5 | 5/5 | 5/5 | 5/5 | 5/5 | 5/5 | 5/5 | 5/5 | 5/5 |
| 5 | 5/5 | 5/5 | 5/5 | 5/5 | 5/5 | 5/5 | 5/5 | 5/5 | 5/5 |
| 6 | 5/5 | 5/5 | 5/5 | 5/5 | 5/5 | 5/5 | 5/5 | 5/5 | 5/5 |
| 7 | 1/5 | 1/5 | 3/5 | 4/5 | 5/5 | 5/5 | 5/5 | 5/5 | 5/5 |

In the following Examples 11-13 and Comparative Examples 8-10, there were used as essential components 10 g/l of cupric sulfate pentahydrate, 45 g/l of ethylenediaminetetraacetic acid, and 3 ml/l of formalin (37%) to adjust the pH 12.50 (at 20° C.). Electroless copper plating was carried out using a plating solution at a liquid temperature of 70° C. for 1 hour with a plating area of 1.0 $dm^2/l$.

Mechanical properties were measured as follows. That is, a stainless steel plate was subjected to a sensitizing treatment for 5 minutes using HS-201B (mfd. by Hitachi Chemical Co., Ltd.), washing with water, followed by activation for 5 minutes using an adhesion accelerator (ADP-201, mfd. by Hitachi Chemical Co., Ltd.). After washing with water, electroless copper plating was carried out to give a plated film of 25 μm to 30 μm thick.

Elongation (%) of plated film was measured by peeling the plated film from the stainless steel plate, cutting the plated film in a size of 10 mm wide and 100 mm long to give a sample to be measured, and subjecting to the measuring using a tensilometer (mfd. by Toyo Baldwin Co.) at a tensile speed of 1 mm/min and chuck distance of 15 mm, referring to JIS Z 2241.

Tensile strength of plated film was measured referring to JIS C6482.

EXAMPLE 11

An electroless copper plating solution was prepared by adding 5 mg/l of potassium ferrocyanide and 0.5 mg/l of L-arginine to the essential components mentioned above. Electroless copper plating was carried out using the resulting plating solution.

Plating deposition rate, plated surface appearance, elongation and tensile strength were shown in Table 5.

EXAMPLE 12

An electroless copper plating solution was prepared by adding 0.05 mg/l of potassium ferrocyanide and 0.05 mg/l of L-arginine to the essential components mentioned above. Electroless copper plating was carried out using the resulting plating solution.

Plating deposition rate, plated surface appearance, elongation and tensile strength were shown in Table 5.

EXAMPLE 13

An electroless copper plating solution was prepared by adding 30 mg/l of potassium ferrocyanide and 50 mg/l of L-arginine to the essential components mentioned above. Electroless copper plating was carried out using the resulting plating solution.

Plating deposition rate, plated surface appearance, elongation and tensile strength were shown in Table 5.

COMPARATIVE EXAMPLE 8

An electroless copper plating solution was prepared by adding 10 mg/l of sodium cyanide and 0.5 mg/l of thiourea to the essential components mentioned above. Electroless copper plating was carried out using the resulting plating solution.

Plating deposition rate, plated surface appearance, elongation and tensile strength were shown in Table 5.

COMPARATIVE EXAMPLE 9

An electroless copper plating solution was prepared by adding 30 mg/l of α,α'-dipyridyl and 0.5 mg/l of 2-mercaptobenzothiazole to the essential components mentioned above. Electroless copper plating was carried out using the resulting plating solution.

Plating deposition rate, plated surface appearance, elongation and tensile strength were shown in Table 5.

COMPARATIVE EXAMPLE 10

An electroless copper plating solution was prepared by adding 5 mg/l of sodium cyanide, 30 mg/l of α,α'-dipyridyl and 0.05 mg/l of 2-mercaptobenzohiazole to the essential components mentioned above. Electroless copper plating was carried out using the resulting plating solution.

Plating deposition rate, plated surface appearance, elongation and tensile strength were shown in Table 5.

TABLE 5

| | | Additive (mg/l) | | | | | | Plating deposition rate (μm/hr) | Plated surface appearance | Elongation (%) | Tensile strength ($kgf/cm^2$) |
|---|---|---|---|---|---|---|---|---|---|---|---|
| | | D | E | F | G | H | I | | | | |
| Examples | 11 | 5 | 0.5 | | | | | 3.14 | Pink | 8.5 | 37 |
| | 12 | 0.05 | 0.05 | | | | | 3.54 | " | 8.3 | 35 |
| | 13 | 30 | 50 | | | | | 2.20 | " | 8.3 | 35 |
| Comparative | 8 | — | — | 10 | | 0.5 | | 2.10 | Pink | 5.4 | 32 |
| Examples | 9 | — | — | | 30 | | 0.5 | 2.00 | Dark pink | 3.5 | 31 |

TABLE 5-continued

| | Additive (mg/l) | | | | | | Plating deposition rate | Plated surface | Elongation | Tensile strength |
|---|---|---|---|---|---|---|---|---|---|---|
| | D | E | F | G | H | I | (μm/hr) | appearance | (%) | (kgf/cm$^2$) |
| 10 | — | — | 5 | 30 | | 0.05 | 1.85 | Pink | 4.7 | 35 |

Note)
D: potassium ferrocyanide
E: L-arginine
F: NaCN
G: α,α'-dipyridyl
H: thiourea
I: 2-mercaptobenzothiazole As mentioned above, the deposited copper obtained by using the electroless copper plating solution is difficult to be covered by an oxidizing film. Thus, even if the electroless copper plating solution is applied to the primary panel electric copper plating-omitting process wherein a dry film is directly laminated without chemical and mechanical polishing, the adhesiveness between the deposited copper and the dry film is excellent. Further, no plating blisters take place and the plating solution is remarkably stable.

Moreover, when the electroless copper plating solution of the present invention is used, there can be obtained plated films remarkably high in ductility and excellent in mechanical properties. In addition, printed wiring boards obtained by using this plating solution are remarkably excellent in connection reliability.

What is claimed is:

1. An electroless copper plating solution comprising a cupric salt, a copper complexing agent, a reducing agent and a pH adjustor as main components, and L-arginine and at least one of α,α'-dipyridyl and a cyano complex compound; the L-arginine being contained in a concentration of 0.05 to 50 mg/l, α,α'-dipyridyl being contained in a concentration of 5 to 100 mg/l and the cyano complex compound being contained in a concentration of 0.05 to 30 mg/l.

2. An electroless copper plating solution comprising a cupric salt, a copper complexing agent, a reducing agent and a pH adjustor as main components, and L-arginine and α,α'-dipyridyl; the L-arginine being contained in a concentration of 0.05 to 50 mg/l and the α,α'-dipyridyl being contained in a concentration of 5 to 100 mg/l.

3. An electroless copper plating solution comprising a cupric salt, a copper complexing agent, a reducing agent and a pH adjustor as main components, and L-arginine and a cyano complex compound; the L-arginine being contained in a concentration of 0.05 to 50 mg/l and the cyano complex compound being contained in a concentration of 0.05 to 30 mg/l.

4. An electroless copper plating solution according to claim 3, wherein the cyano complex compound is at least one member selected from the group consisting of sodium ferrocyanide, potassium ferrocyanide, sodium ferricyanide, potassium ferricyanide, potassium nickel-cyanide and sodium nitroprusside.

5. An electroless copper plating solution comprising a cupric salt, a copper complexing agent, and a reducing agent and a pH adjustor as main components, and L-arginine, α,α'-dipyridyl and a cyano complex compound; the L-arginine being contained in a concentration of 0.05 to 50 mg/l, the α,α'-dipyridyl being contained in a concentration of 5 to 100 mg/l and the cyano complex compound being contained in a concentration of 0.05 to 30 mg/l.

6. An electroless copper plating solution according to claim 5, wherein the cyano complex compound is at least one member selected from the group consisting of sodium ferrocyanide, potassium ferrocyanide, sodium ferricyanide, potassium ferricyanide, potassium nickel-cyanide and sodium nitroprusside.

7. An electroless copper plating solution according to claim 4, wherein the cyano complex compound is potassium ferrocyanide or potassium nickel cyanide or a mixture thereof.

* * * * *